US005150507A

United States Patent [19]

Goela et al.

[11] Patent Number: 5,150,507

[45] Date of Patent: Sep. 29, 1992

[54] METHOD OF FABRICATING LIGHTWEIGHT HONEYCOMB STRUCTURES

[75] Inventors: Jitendra S. Goela, Andover; Michael Pickering, Dracut; Raymond L. Taylor, Saugus, all of Mass.

[73] Assignee: CVD Incorporated, Woburn, Mass.

[21] Appl. No.: 626,608

[22] Filed: Dec. 12, 1990

Related U.S. Application Data

[62] Division of Ser. No. 389,248, Aug. 3, 1989, abandoned.

[51] Int. Cl.[5] ..... B23P 19/04

[52] U.S. Cl. ..... 29/460; 29/457; 156/89; 428/116

[58] Field of Search ..... 29/425, 460, 457, 897.31, 29/897.32; 52/806, 807, DIG. 10; 428/73, 116, 119, 135, 138, 698, 408; 65/18.1, 18.3, 18.4, 23, 36, 42, 38, 43; 156/89; 264/248, 259; 493/89, 90, 91, 110, 312, 966

[56] References Cited

U.S. PATENT DOCUMENTS

| | | | |
|---|---|---|---|
| 3,507,737 | 4/1970 | Busdiecker et al. | 65/43 |
| 4,578,303 | 3/1986 | Kundinger et al. | 52/806 X |
| 4,716,064 | 12/1987 | Holzl et al. | 428/73 |
| 4,917,934 | 4/1990 | Sempolinski | 428/116 |
| 4,956,217 | 9/1990 | Heitkamp | 52/806 X |

FOREIGN PATENT DOCUMENTS

| | | | |
|---|---|---|---|
| 224252 | 5/1958 | Australia | 52/807 |

*Primary Examiner*—Joseph M. Gorski
*Assistant Examiner*—S. Thomas Hughes
*Attorney, Agent, or Firm*—Gerald K. White

[57] ABSTRACT

A process is disclosed for fabricating lightweight honeycomb type structures out of material such as silicon carbide (SiC) and silicon (S). The lightweight structure consists of a core to define the shape and size of the structure. The core is coated with an appropriate deposit such as SiC or Si to give the lightweight structure strength and stiffness and for bonding the lightweight structure to another surface. The core is fabricated from extremely thin ribs of appropriately stiff and strong material such as graphite. First, a graphite core consisting of an outer hexagonal cell with six inner triangular cells is constructed from the graphite ribs. The graphite core may be placed on the back-up side of a SiC faceplate and then coated with SiC to produce a monolithic structure without the use of any bonding agent. Cores and methods for the fabrication thereof in which the six inner triangular cells are further divided into a plurality of cells are also disclosed.

7 Claims, 8 Drawing Sheets

METHOD OF FABRICATING LIGHTWEIGHT HONEYCOMB STRUCTURES

This invention was made with Government support under NASA Contract No. NAS1-18476 awarded by NASA. Work toward this invention was also performed under Air Force Contract No. F33615-87-C-5227. The Government has rights in this invention.

This is a divisional of co-pending Ser. No. 07/389,248 filed on Aug. 3, 1989, now abandoned.

BACKGROUND OF THE INVENTION

1. Field of the Invention

This invention relates to an improved method of fabricating stiff and strong lightweight structures, and more particularly, to an improved method for the fabrication of silicon carbide (SiC) and/or silicon (Si) lightweight structures by the utilization of conventional vapor deposition techniques. Such lightweight structures have utility in a variety of diverse applications including back-up structures for optical components, as structural components for automobile, aerospace and space applications, and as lightweight furniture parts for space.

2. Description of the Prior Art

In the field of optics, light detection and ranging (LIDAR) has come to be recognized as an important diagnostic tool for remote measurement of a diversity of atmospheric parameters such as minor species concentrations, pressure, temperature, and water vapor profiles, aerosol cloud distributions, and wind fields. LIDAR techniques such as measurement of back scattered signals, differential absorption, and Doppler shifts have been used to obtain information about the earth's atmosphere.

The performance of a LIDAR system depends upon the optical configuration of its receiving telescope. Often, due to space limitations such as in a shuttle borne LIDAR system, the length of the telescope is fixed. Therefore, the optical designer must select a particular shape and optics speed of the mirrors to maximize the throughput of the telescope. The most critical element in the receiving telescope is the primary mirror because of its size, weight, fabrication cost, and thermal exposure to the outside world. Since the received signal is directly proportional to the area of the primary mirror, it is important to use as large a primary mirror as feasible to obtain reasonable signal levels for accurate measurement. This is particularly true when a space-borne LIDAR system is used to measure wind profiles in the troposphere on a global basis.

The conventional techniques employed in the prior art for fabricating large ($\geqq$1.0 meter diameter) mirrors are quite slow and time consuming. Several months to years are required to fabricate a large mirror from ultra low expansion silica glass or Zerodur, a product commercially available from Schott Glass Technologies, Inc., 400 York Avenue, Duryea, Pa. 18642. Since a number of space-based LIDAR systems are planned for the future, considerable attention is currently being given to the development of techniques for the rapid and economic production of large, high performance mirrors.

Thus, a spin casting technique has been proposed to fabricate 1.2 meter and 3.5 meter diameter glass mirror blanks containing lightweight honeycomb cells. Although this technique is relatively faster than the conventional mirror fabrication methods and produces lightweight mirrors, the weight of these mirrors is still an order of magnitude more than permissible for many space applications. Further, the spin-casting technique is unsuitable for fabricating large mirrors of advanced ceramics such as SiC, titanium diboride ($TiB_2$), and boron carbide ($B_4C$) that have high melting points. These latter materials have properties superior to those of glass for large lightweight optics.

Other techniques involving the casting of fiber reinforced composites containing epoxy and plastics and the stretching of membranes over appropriate substrates are also currently under investigation.

Still another technique for making stiff lightweight structures is disclosed in U.S. Pat. No. 4,716,064 granted to Robert A. Holzl et al. on Dec. 29, 1987. The Holzl et al. patent emphasizes a requirement for two parallel separated surface defining members that are connected by stiffeners. Fabrication starts with a solid graphite disc which defines the outer envelope to the part to be produced. Then, by a series of drillings of bores or holes in the graphite disc, the use of plugs and multiple coatings of a chemically vapor deposited material possessing a high stiffness to weight ratio, the part is constructed. A disadvantage of this fabrication procedure is that it is time consuming, complex and costly. Moreover, the many steps of drilling, plugging, and multiple coating involved inherently limit the ability to control figure stability. This impairs the value of the process where extreme figure stability retention is of importance, as in high performance mirrors. Additionally, the Holzl et al. technique is limited to relatively thin structures because of the difficulty of obtaining uniform coatings in the passages between the spaced parallel surface defining members.

Thus, there is a need and a demand for improvement in the methods of fabrication of stiff and strong lightweight structures to the end of achieving extreme figure stability retention as well as an amenability to being scaled up in size while at the same time enabling simplification in the fabrication procedure and reduction in the time required for and the cost of such procedure.

SUMMARY OF THE INVENTION

An object of the invention is to provide an improved method for fabricating stiff and strong lightweight structures that are characterized by extreme figure stability retention.

Another object of the invention is to provide an improved method enabling simplification in, reduction in time required for, and cost of fabricating stiff and strong lightweight structures.

A further object of the invention is to provide an improved stiff and strong lightweight structure.

An additional object of the invention is to provide such a structure having particular utility as back-up structure in the fabrication of lightweight mirrors.

Another object of the invention is to provide a stiff and strong lightweight structure comprising a plurality of ribs each of which has a length and a height that are greatly in excess of the thickness thereof, the ribs being assembled in the form of a structure having a plurality of cells and a stiffening and strengthening material coated on and enclosing the ribs, such material comprising a material that is vapor deposited on the ribs.

Still another object of the invention is to provide a method of fabricating a lightweight structure from a plurality of ribs each of which have substantially the same height and thickness with the height and length greatly exceeding the thickness, comprising the steps of:

(a) forming from a first set of said ribs, each of which are of substantially the same length, a hexagonal cell having a depth equal to the height of said ribs, (b) forming slots in the center of first, second and third ones of a second set of said ribs which ribs are all of the same length and substantially equal to the distance between the most widely spaced corners of said hexagonal cell, with a first slot from the top of a first one of said ribs, a second slot from the bottom of said second one of said ribs, and third and fourth slots from both the top and bottom of said third one of said ribs, with the lengths of said first and second slots being greater than half the height of said ribs and the lengths of said third and fourth slots being less than half the height of said ribs, (c) interlocking said first, second and third ones of said ribs at the centers thereof by bringing said first and second slots into cooperative relation with said third and fourth slots, respectively, (d) positioning said interlocked first, second and third ones of said ribs relatively to said hexagonal cell to connect the most widely spaced corners thereof thereby to form a structure core having six regions each of equilateral triangular cross section with each such region comprising a cell, and (e) exposing the structure core to a vapor deposition process to deposit and coat thereon a stiffening and strengthening material thereby to enclose said structure core in a monolithic structure of such material.

Still another object of the invention is to provide an improved method for fabricating such an improved stiff and strong lightweight structure that is characterized by the adaptability thereof for fabrication in various predetermined configurations.

A further object of the invention is to provide an improved method for fabricating stiff and strong lightweight structures that is characterized by the adaptability thereof for scaling up in size.

In accomplishing these and other objectives, there is provided, in accordance with the invention, a four step process for fabricating lightweight structures out of SiC and/or silicon (Si). The lightweight structure consists of a core to define the shape and size of the structure, overcoated with an appropriate deposit, such as SiC or Si, to give the lightweight structure strength and stiffness and to bond the lightweight structure to another surface.

The lightweight structure core is fabricated by bonding together thin ribs of a suitable material with a compatible bonding agent. The core may consist of many honeycomb cells of appropriate shapes. This core structure may be placed on a suitable substrate the surface configuration of which may be predetermined. The substrate may be coated with a release agent. A desired overcoat material is then deposited on the core structure by employing conventional or other appropriate deposition processes. A sufficient thickness of the overcoat material is deposited to ensure that the core is totally coated. The lightweight structure so fabricated is unloaded from the deposition system and separated from the substrate. If necessary or desirable, the enclosed core material may be removed by drilling small holes in the walls of the structure, followed by burning, etching or melting of the core material away from the deposited overcoat material.

Fabrication of the lightweight structure in accordance with the four step process thus is as follows: (i) fabrication of a lightweight structure core; (ii) mounting of the lightweight structure core on a substrate for deposition of the overcoat material; (iii) deposition of the overcoat material to enclose the core; and (iv) core removal from the substrate.

The lightweight structure core may be fabricated using a metal or non-metal as the core material, including plastics, ceramics, carbon, glass, polymer, etc. The main requirement for a good candidate core material is that it should be compatible with the deposition process and material. Thin ribs of the core material are obtained and then assembled in the form of a honeycomb structure. The ribs may be joined together at the corners and intersections with a suitable bonding agent, as known to those skilled in the art. Other joining processes such as welding, brazing, soldering, may also be used.

Each cell of the honeycomb structure may be in the shape of a circle, square, rectangle or a polygon. The lightweight structure may also be fabricated with a combination of different cell shapes. The preferred structure, however, is the one which has the greatest stiffness for the intended application, such as one involving hexagonal cells, each of which contain six triangular cells.

The invention has particular utility in the fabrication of lightweight Si/SiC mirrors. Thus, a complete lightweight mirror substrate may be fabricated directly in a vapor deposition chamber, in a one-step process, with no bonding agent being required to attach the SiC backup structure to the faceplate of the mirror.

The various features of novelty which characterize the invention are pointed out with particularity in the claims annexed to and forming a part of this specification. For a better understanding of the invention, its operating advantages, and specific objects attained by its use, reference is made to the accompanying drawings and descriptive matter in which preferred embodiments of the invention are illustrated.

BRIEF DESCRIPTION OF THE DRAWINGS

With this summary of the invention, a detailed description follows with reference being made to the accompanying drawings which form part of the specification, of which.

DESCRIPTION OF THE PREFERRED EMBODIMENTS

Figure 1:
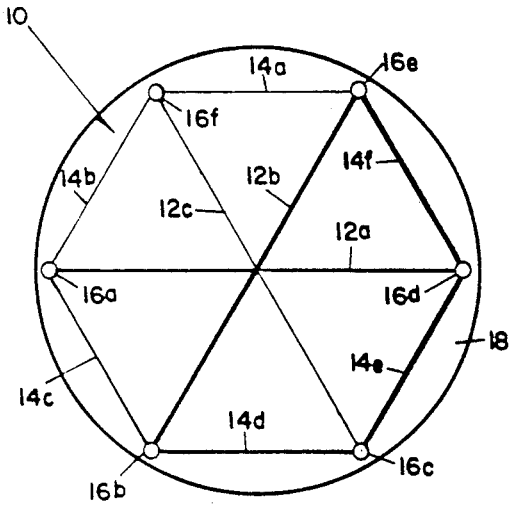
FIGS. 1 and 2 are plan and front views, respectively, of a lightweight structure core mounted, in accordance with a first embodiment of the invention, for deposition thereon of an overcoat material.
Figure 2:
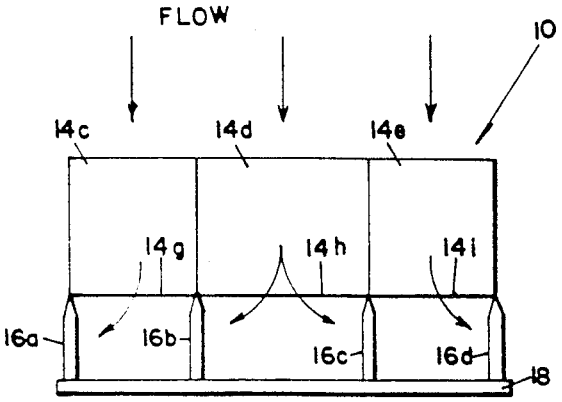

FIGS. 1 and 2 of the drawings illustrate a lightweight structure core 10 that is fabricated from graphite ribs 12*a*, 12*b*, 12*c* and 14*a* . . . 14*f*. The core 10 is fabricated such that the ribs 14*a* . . . 14*f*, which are all of the same length, form a hexagonal cell. The ribs 12*a*, 12*b* and 12*c* intersect in the center and connect the six corners of the hexagon. Ribs 12*a*, 12*b* and 12*c* also divide the hexagon into six triangular parts. Ribs 12*a*, 12*b* and 12*c* are fabricated with center slots, as described further hereinafter with reference to FIGS. 3 and 4, to interlock them in place.

In the preferred embodiments of the invention, the ribs all have a thickness of about 0.5 mm.(0.020 inch). Further, the ribs are all characterized in having a high ratio of the length and height thereof to their thickness. That is to say, the length and the height of each rib greatly exceeds its thickness.

Figure 5:
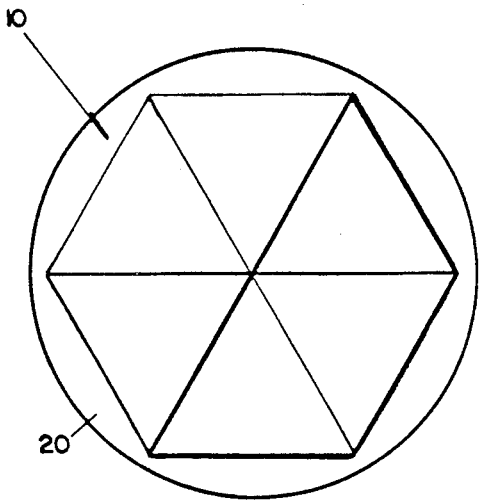
FIGS. 5 and 6 are plan and front views, respectively, of a lightweight structure core mounted, in accordance with a second embodiment of the invention, for deposition thereon of an overcoat material.
Figure 6:
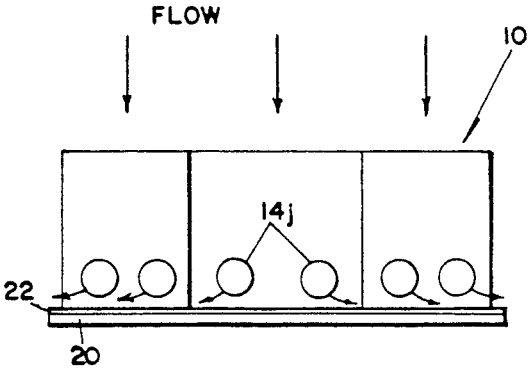
Figure 8:
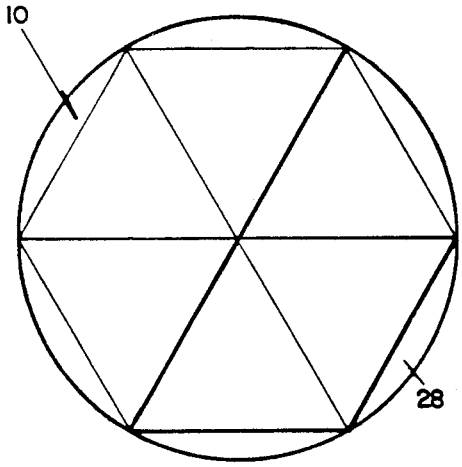
FIGS. 8 and 9 are plan and front views, respectively, of a lightweight structure core mounted, in accordance with a third embodiment of the invention, for deposition thereon of an overcoat material.
Figure 9:
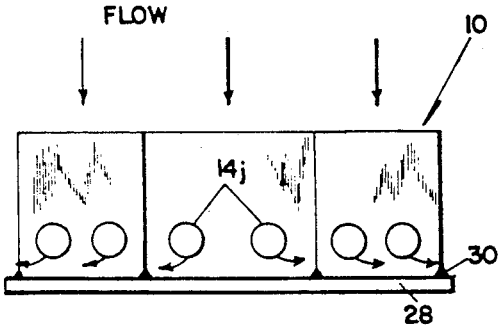

In the invention embodiment illustrated in FIGS. 1 and 2 and those illustrated, also, in FIGS. 5 and 6 and in FIGS. 8 and 9, all of the ribs have at least two adjacent surfaces that form a first elongated edge, all portions of which are located in a single plane, such as that containing the bottom edges 14*g*, 14*h* and 14*i* shown in FIG. 2.

Figure 3:
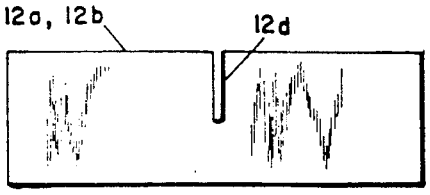
FIG. 3 is a detailed view of two of the three intersecting and interlocking ribs of the lightweight structure core of FIGS. 1 and 2.
Figure 4:
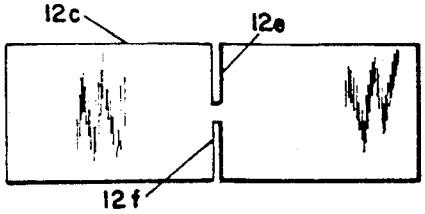
FIG. 4 is a detailed view of the third one of the intersecting and interlocking ribs of the lightweight structure core of FIGS. 1 and 2.

To the end that the ribs 12*a*, 12*b* and 12*c* may interlock with each other at the center thereof, two of the ribs, 12*a* and 12*b*, for example, as shown in FIG. 3, are provided in a first elongated edge with a single transverse slot 12*d* that extends slightly more than half way through the height of the rib. The third rib, 12*c*, as shown in FIG. 4, is provided at the centers thereof, in a first elongated edge and in a second elongated edge, with opposed transverse slots 12*e* and 12*f*, respectively, that extend less than half way through the height of the rib 12*c*. Assembly of the ribs 12*a* . . . 12*c* in operative relation is effected by placing the slots 12*d* of ribs 12*a* and 12*b* in interlocking relation with opposed transverse slots 12*e* and 12*f*, each of which slots extends less than half way through the height of rib 12*c*. Ribs 14*a* . . . 14*f* are positioned to define the outer perimeter of a structure 10 having six sides with three pairs of most widely spaced corners and forming six cells, that is, to complete a hexagon, as shown.

The graphite ribs 12*a* . . . 12*c* and 14*a* . . . 14*f* may be joined with a graphite cement. Graphite is a good core material because it is compatible with most deposition procedures. Further, several different types of graphite with different thermal expansion coefficients are available. A particular graphite having a thermal expansion coefficient closely matching that of an overcoat material to be deposited can be selected. A disadvantage of graphite is that it is a fragile material. Thus, difficulties may be encountered in the fabrication of lightweight structure cores with graphite rib thicknesses less than 0.5 mm. (0.020 inch). The graphite rib thickness may be reduced to less than 0.5 mm., however, by burning of the rib in air. Other strong and stiff materials such as Si, SiC, tungsten (W), molybdenum (Mo), etc. may also be used to fabricate extremely thin wall lightweight structure cores.

Mounting of the lightweight structure core 10 in a deposition system for deposit thereon of a suitable deposition material depends upon the application for which the lightweight structure is intended to be used. If only the lightweight structure core is required without any plate or substrate at either end, the lightweight structure core may be mounted on graphite poles 16*a* . . . 16*f* attached to a substrate 18, as shown in FIG. 2, with the edges of the ribs engaging the tips of the poles. After the deposition of the overcoat material is completed, the lightweight structure is obtained by separating the structure from the poles, as by cutting.

Figure 7:
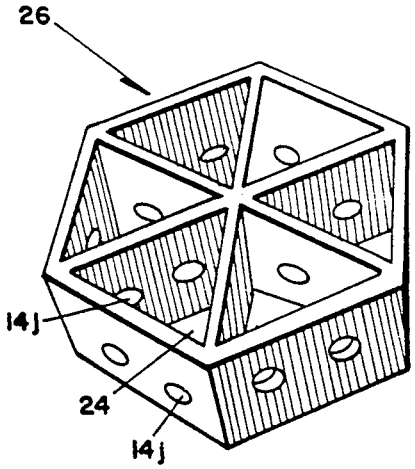
FIG. 7 is a perspective view of a chemically vapor deposited SiC lightweight structure produced utilizing the lightweight structure core mounted as shown in FIGS. 5 and 6.

If a plate of the deposited material is required at one end of the lightweight structure, the lightweight structure core 10 either may be loosely bonded to or placed on a substrate 20 coated with a mold release substance 22, as shown in FIGS. 5 and 6. A suspension of graphite particles in an organic solvent may be used as the mold release coating. With such use, deposition will occur not only on the walls of the lightweight structure core 10 but also at the base thereof. On completion of the deposition process, the lightweight structure with a base plate 24 of overcoat material formed thereon is separated from the substrate 20. In FIG. 7, there is illustrated a perspective view of a SiC totally enclosed graphite lightweight structure 26 fabricated by this method.

Figure 10:
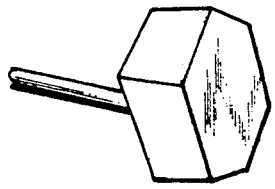
FIG. 10 is a perspective view of a chemically vapor deposited fabricated SiC lightweight structure bonded to a SiC faceplate produced utilizing the lightweight structure core mounted as shown in FIGS. 8 and 9.

In some applications such as the fabrication of lightweight Si or SiC mirrors, it may be desirable simultaneously to fabricate the lightweight structure and bond it to a faceplate of a desired material. In such cases, a lightweight structure core 10, as shown in FIGS. 8 and 9, is bonded to a faceplate 28, as by flow bonding indicated at 30, and the deposition operation is performed. The material of the faceplate should be compatible with the deposition process to assure adherence of the deposited material. FIG. 10 illustrates a SiC enclosed graphite lightweight structure bonded to a SiC faceplate which has been fabricated by the use of this method.

In order to enclose the lightweight structure core, an appropriate overcoat material may be deposited by any of the vapor deposition processes that are currently available. These processes include physical vapor deposition, sputtering, chemical vapor deposition and its different types (plasma assisted vapor deposition, low pressure vapor deposition, laser assisted vapor deposition, metal organic vapor deposition, etc.), evaporation and ion beam implantation. The materials which can be deposited include metals and nonmetals (plastics, ceramics, glasses, polymers, etc.).

Figure 11:
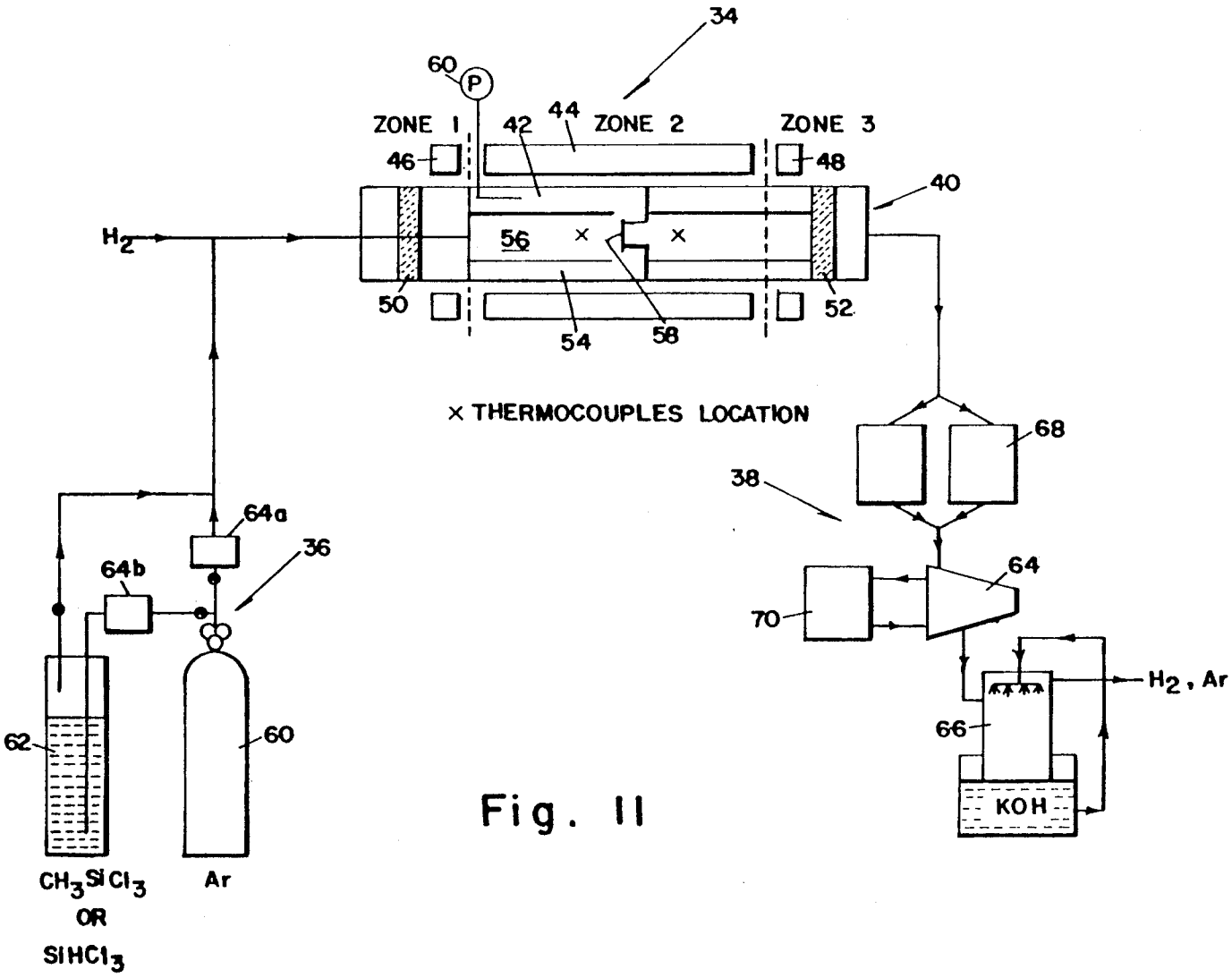
FIG. 11 is a schematic illustration of a chemically vapor deposition apparatus that may be employed to fabricate SiC and Si lightweight structures, as illustrated in FIGS. 1–10.

FIG. 11 schematically illustrates a chemical vapor deposition apparatus, designated 32, that may be used to fabricate SiC and Si lightweight structures in accordance with the invention. This apparatus 32 includes a horizontal research furnace 34, specifically an electrically heated 3-zone Lindberg furnace, a reactant supply system 36, and an exhaust system 38.

Associated with furnace 34 is an elongated tube 40 of aluminum oxide ($Al_2O_3$) containing a reaction or deposition chamber 42 that is substantially coextensive with zone 2. Zone 2, as shown, is heated by a heating element 44 while zones 1 and 3 are heated by individually associated heating elements 46 and 48, respectively. Blocks of firebrick, designated 50 and 52, are located outside tube 40 in the regions thereof respectively associated with zones 1 and 3.

The deposition region within chamber 40 is indicated at 54 and, as shown, has associated therewith a mandrel 56 consisting of four sides of an open box and a baffle plate 58. The pressure within chamber 42 is indicated by a pressure gauge 60.

Mounting, as by bonding, of the lightweight structure core 10 on the baffle plate 58 for the deposition thereon of an overcoat material is preferred. This is for the reason that such mounting provides minimal deposition nonuniformity from cell to cell in the lightweight structure core.

The reactant supply system 36 includes a tank 60 comprising a source of argon (Ar) under pressure, a bubbler tank 62 containing methyltrichlorosilane ($CH_3SiCl_3$) or trichlorosilane ($SiHCl_3$) through which argon from source 60 is bubbled under control of valves 64*a* and 64*b*, and a separate source (not shown) of hydrogen ($H_2$). The SiC and Si material to be deposited is fabricated by reacting $Ch_3SiCl_3$ or $SiHCl_3$ with $H_2$, respectively. Other silane and hydrocarbon sources can be used to form SiC and Si. Both of these materials have been fabricated over a wide range of deposition temperature and reactor pressure, as shown in Table I below.

TABLE I

| | | NOMINAL CVD PROCESS PARAMETERS USED TO FABRICATE SiC AND Si LIGHTWEIGHT STRUCTURES | | | | | |
|---|---|---|---|---|---|---|---|
| | | FLOW RATES (Slpm) | | | | | |
| Si No. | Material Produced | $H_2$ | $CH_3SiCl_3$ or $SiCl_3$ | Ar | Deposition Temperature C. | Reactor Pressure torr | Deposition Rate μm/min. |
| 1 | SiC | ≦10 | ≦2.0 | ≦4.0 | 1050-1350 | 25-300 | ≦1.25 |
| 2 | Si | ≦15 | ≦2.0 | ≦5.0 | 830-1250 | 25-300 | ≦1.75 |

The reagents may be introduced into the deposition chamber 42 through a central injector (not shown). The injector may be cooled with water to (i) prevent deposition in the injector and (ii) to keep the temperature of the reagents low thereby minimizing gas phase decomposition or nucleation. The deposition thickness is controlled by varying the chemical vapor deposition process parameters and the deposition time. After a sufficient thickness of the material is deposited, the deposition process is terminated and the furnace is cooled very slowly to prevent cracking and distortion of the lightweight structure due to residual stresses.

The exhaust system 38 shown in FIG. 11 includes a vacuum pump 64, a scrubber 66, gaseous filters 68 and an oil filter 70. The exhaust system 38 is provided to evacuate the gaseous reaction products that are released in the reaction chamber 42 during the deposition process.

Removal of the graphite core, as mentioned previously, is optional. Since the deposited material completely encloses the core material, it is not necessary to remove the core material. As those skilled in the art understand, a core material can be selected the presence of which will not degrade the performance of the lightweight structure. Candidate core materials are graphite, Si, glass, quartz and various metals.

It is noted that when a vapor deposition technique is used to fabricate a lightweight structure, the gaseous flow in the lightweight structure, as illustrated by the arrows in FIG. 2, is a "stagnation" flow governed by diffusion. This tends to yield deposition nonuniformity along the cell depth where the undesired effects of stagnation flow tend to be the greatest. By the term "stagnation flow" is meant a flow that is sluggish or lacking in activity, that is, a flow that has little motion or power of motion.

In accordance with the invention, such stagnation flow may be minimized by providing holes 14*j*, as shown in FIGS. 6, 7 and 9, in the walls of the lightweight structure core 10, and in particular, the walls of adjacent cells. This results in a gaseous flow, as illustrated by the arrows in FIGS. 6 and 9, and improves the strength of the lightweight structure that is produced. The preferred location for the holes 14*j* is on the walls near the base of the lightweight structure core, that is, adjacent the substrate 20, as seen in FIG. 6, and adjacent the faceplate 28, as seen in FIG. 9.

EXAMPLE I

The SiC enclosed graphite lightweight structure shown in FIG. 7 was fabricated by the above method described in connection with the deposition apparatus shown in FIG. 11 and involving process parameters as given in TABLE I. The lightweight structure core was constructed from graphite ribs about 0.5 mm. thick, 3.25 cm. long and 2.5 cm. high. The deposition thickness was about 0.76 mm. (0.03 inch). The lightweight structure produced was quite strong and rigid. There were no apparent stresses or cracks in the structure.

EXAMPLE II

The chemical vapor technology of fabricating a lightweight back-up structure was demonstrated by fabricating a one cell SiC structure on the backside of a faceplate. First, a graphite core consisting of an outer hexagonal cell with six inner triangular cells, as illustrated in FIGS. 8 and 9, was constructed from graphite ribs about 0.5 mm. thick. Each side of this hexagonal cell was 3.25 cm. long and 2.50 cm. high. This graphite core was placed on the backside of the SiC faceplate and then coated with SiC. This process produced a monolithic lightweight SiC structure without the use of any bonding agent. To avoid residual stresses in the structure, a grade of graphite was used which has a thermal expansion coefficient larger than that of the chemically vapor deposited SiC.

A coating of Si about 0.5 mm. thick on the near-net shape SiC faceplate was applied to permit fabrication of the final optical figure. To obtain a more uniform Si coating, the SiC faceplate was mounted such that the flow directly impinged on the replicated surface. Since the Si coating is required only on the front surface of the mirror, all other areas were masked with grafoil. The mirror was polished flat to a figure of 1/5th of a wave at 0.6328 $\mu$m and a finish of $\leqq$10A RMS.

In accordance with the invention, the aforementioned procedure may also be extended to fabricate curved Si/SiC mirrors of scaled up size and lightweight back-up structures therefor.

When fabricating structure cores for use as back-up structure for flat mirrors, the assembly of the ribs, as previously mentioned, is such that all of the ribs have at least two adjacent surfaces that form an edge, all portions of which lie in a single plane. Thus, contiguous edge portions of the plurality of cells formed by the assembly of the ribs all lie in the same plane. In the case of the fabrication of structure cores for use as back-up structure for curved mirrors, contiguous edge portions of the cells of the structure formed by the ribs, when assembled, lie on a curved surface.

The fabrication of curved mirrors is more involved, as is apparent from the description provided hereinafter, due to (i) the optical fabrication of a curved surface required, and (ii) fabrication and assembly of a graphite core for the lightweight structure. In other respects, the fabrication of curved and flat mirrors is similar.

In order to scale the lightweight SiC back-up structure, first the graphite core is scaled. Since the thickness of the graphite ribs is kept the same during scaling, considerable care is required to assemble a large size graphite structure core.

Figure 12:
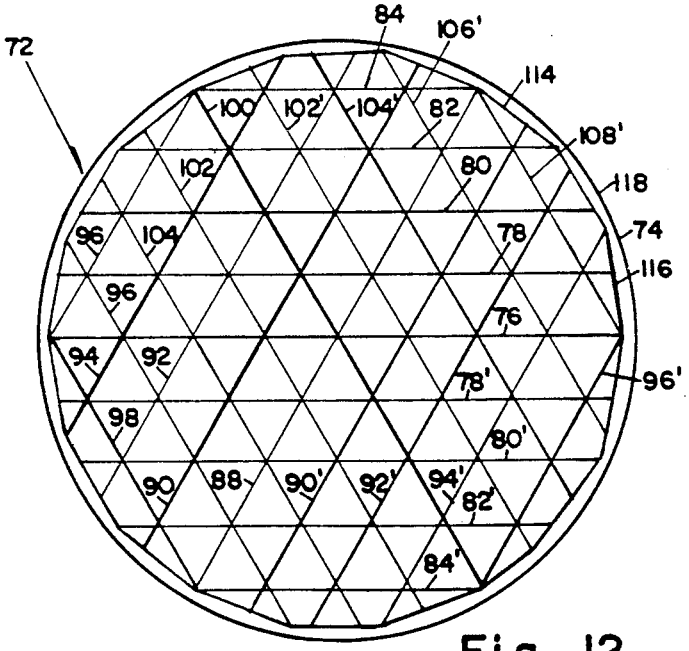
FIGS. 12 and 13 are plan and side views, respectively, of a scaled up in size lightweight back-up structure core assembly having utility in the formation by chemical vapor deposition of a monolithic lightweight Si/SiC mirror faceplate and the back-up structure therefor.
Figure 13:
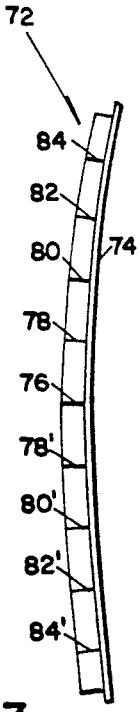

FIGS. 12 and 13 illustrate plan and side views, respectively, of a scaled up lightweight structure core according to the invention. The lightweight structure core, designated 72, comprising a fourth embodiment of the invention, has particular utility as the back-up structure for lightweight Si/SiC curved mirrors as distinguished from flat mirrors, as shown in FIGS. 7 and 10. Two methods are disclosed herein for the fabrication of the lightweight structure core 72.

The lightweight structure core 72, as shown in FIG. 12, is fabricated from six ribs of equal length which are positioned such that a large hexagonal cell having a depth equal to that of the ribs covers most of the backside of a circular faceplate 74. Connecting most widely spaced ones of the six corners of this hexagon are three large ribs which intersect at their centers. These ribs also divide the hexagon into six equal triangular parts. These large ribs, similarly to ribs 12*a*, 12*b* and 12*c* shown in FIGS. 3 and 4, are fabricated with center slots to interlock them in place.

More specifically, in the fabrication of the lightweight structure core 72, six outer sides of a large hexagon comprising ribs of a first set, all of which have the same length, and three central ribs comprising ribs of a second set, all of which have the same length, are bonded together. Next the six triangular regions that are formed within the hexagon are filled with ribs of a third set to form smaller cells of equilateral cross section and bonded together to complete the inner region. The region outside the hexagon may then be closed with ribs of a fourth set to cover as much of the circular area of the faceplate 74, as possible.

Figure 14:
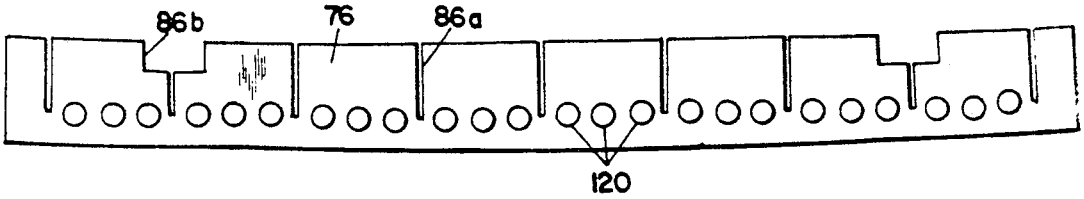
FIGS. 14–30 are side views illustrating the shapes of the ribs used in the back-up structure core assembly of FIGS. 12 and 13, with the assembly being in accordance with a first and preferred method.
Figure 15:
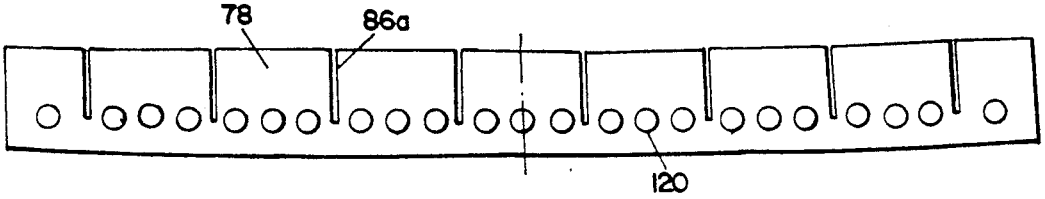
Figure 16:
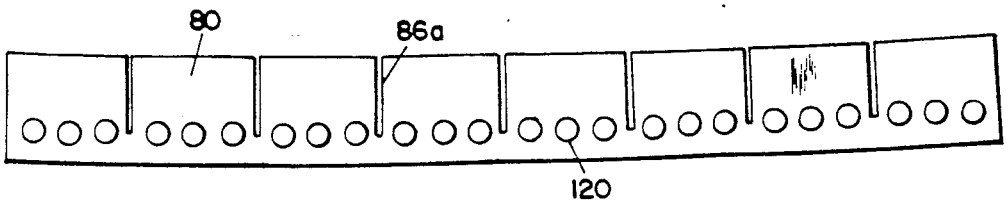
Figure 17:
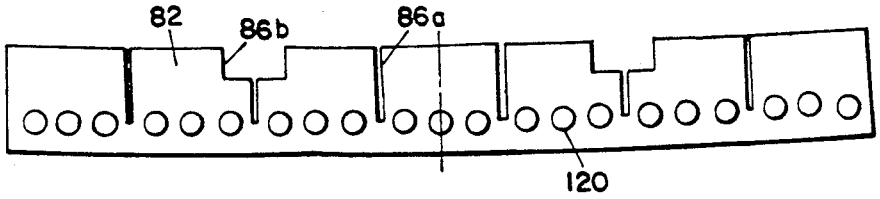
Figure 18:
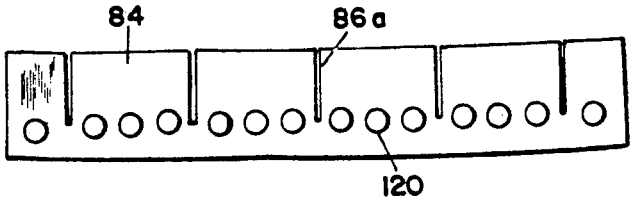

Details of the assembly of the lightweight structure core 72 of FIGS. 12 and 13, according to a preferred method of assembly, are described herein with reference to FIGS. 14–30. As shown in FIG. 12, ribs 76, 78, 80, 82 and 84 are positioned in parallel in equally spaced apart relation. The ribs 76 . . . 84 all have different lengths and are each provided in a first elongated edge with uniformly spaced slots, designated 86*a* at the top, as shown in FIGS. 14–18, respectively. Each of ribs 76 and 82, as shown in FIGS. 14 and 17, also include two spaced notches, designated 86*b*, at the top. There are two pieces for each of the ribs 78 . . . 84, the second piece in each case being designated by a prime mark (′) in FIG. 12. One of the two pieces in each case is positioned in the upper half of the large hexagon, as seen in FIG. 12, and the other piece is positioned in the lower half. Thus, rib 84 is positioned in the top half and rib 84′ is positioned in the bottom half.

Figure 19:
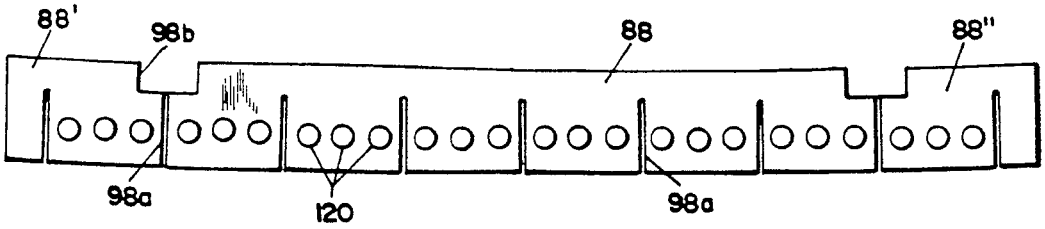
Figure 20:
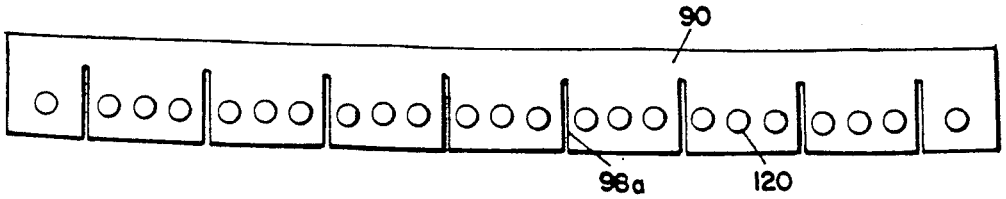
Figure 21:
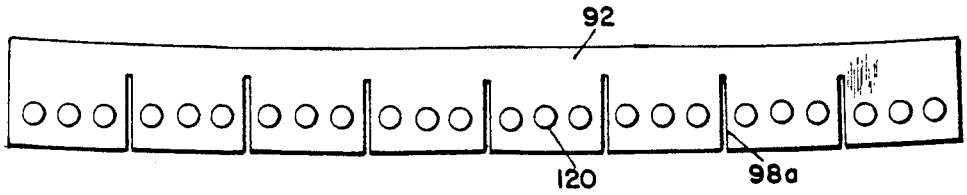
Figure 22:
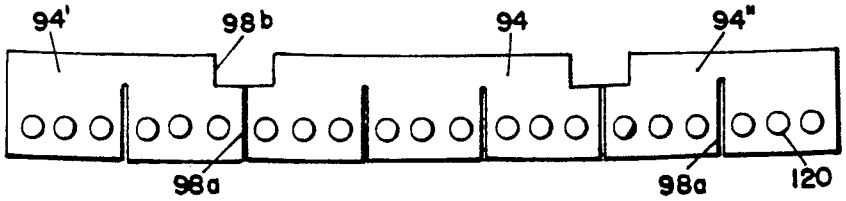
Figure 23:
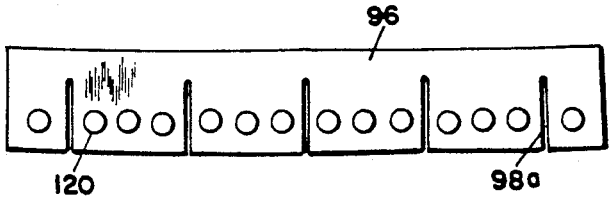
Figure 24:
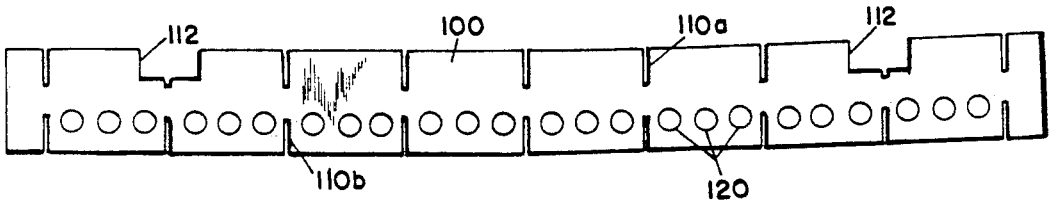
Figure 25:
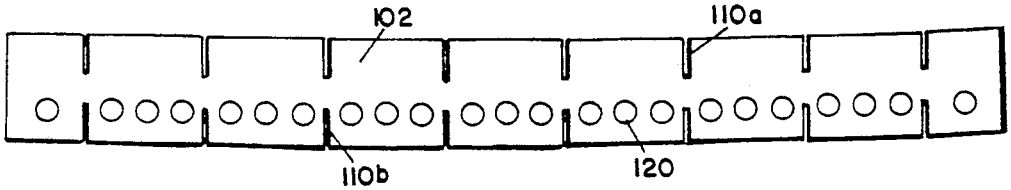
Figure 26:
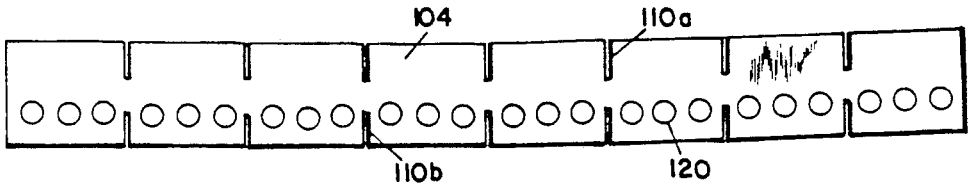
Figure 27:
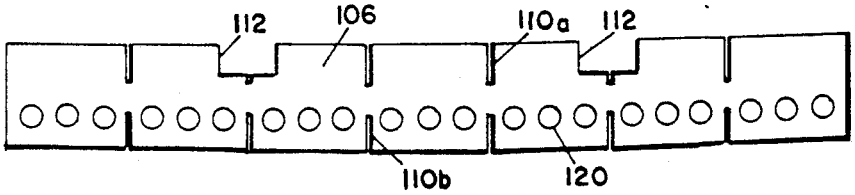
Figure 28:
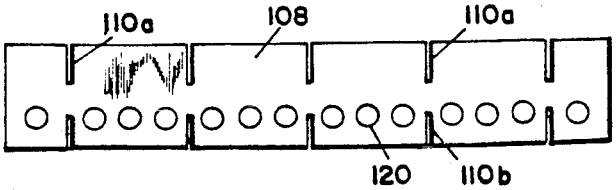

Additional parallel positioned and equally spaced apart ribs, designated 88, 90, 92, 94 and 96, as seen in FIG. 12, all have different lengths and are each provided in a second elongated edge with uniformly spaced slots, designated 98*a* at the bottom, as shown in FIGS. 19–23, respectively, with ribs 88 and 94 also having two notches, designated 98*b*, at the top or first elongated edges thereof. Note that the ribs are made up of three parts when the slots are made into the notches. Thus, rib 88, as shown in FIG. 19, comprises three parts that are designated 94, 94′ and 94″. Similarly rib 94, as shown in FIG. 22, comprises three parts that are designated 94, 94′ and 94″. There are two pieces of each of the ribs 90 . . . 96, with the second piece being designated by a prime mark. The two rib pieces, 96 and 96′, thus are positioned at opposite sides of the large hexagon, as shown.

Further parallel positioned and equally spaced ribs, designated 100, 102, 104, 106 and 108, as seen in FIG. 12, all have different lengths and are provided with uniformly spaced slots, designated 110*a*, at the top or first elongated edge and uniformly spaced slots, designated 110*b*, at the bottom or second elongated edge, as shown in FIGS. 24–28, respectively, with two spaced notches, each designated 112, being provided in the top of ribs 100 and 106. There are two pieces of each of the ribs 102 . . . 108, with the second piece being designated by a prime mark.

Figure 29:
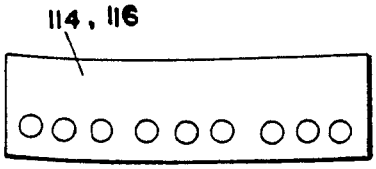
Figure 30:
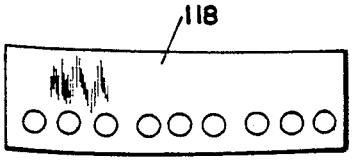

As shown in FIG. 12, the region outside the large hexagon may be closed by a total of 12 ribs designated 114 (or 116) and there are six ribs designated 118. Ribs 114, 116, as shown in FIG. 29, and ribs 118, as shown in FIG. 30, are not provided with any slots. For convenience of illustration, the closure segments 114, 116 and 118 are not shown in FIG. 13.

Thus, there are a total of 45 pieces that are required to assemble the lightweight back-up structure core 72. There are flow holes, designated 120, that are provided in the ribs. Each cell has such holes.

Figure 31:
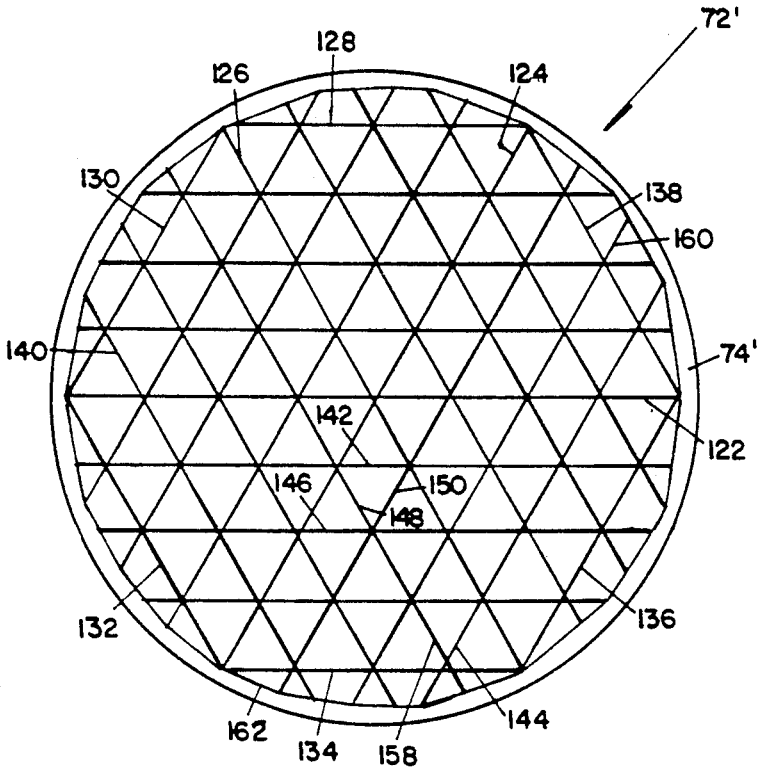
FIGS. 31 and 32 are plan and side views, respectively, of a scaled up in size lightweight back-up structure core assembly having utility in the formation by chemical vapor deposition of a monolithic lightweight Si/SiC mirror faceplate and the back-up structure therefor, with the assembly of the lightweight back-up structure core being by a second method.
Figure 32:
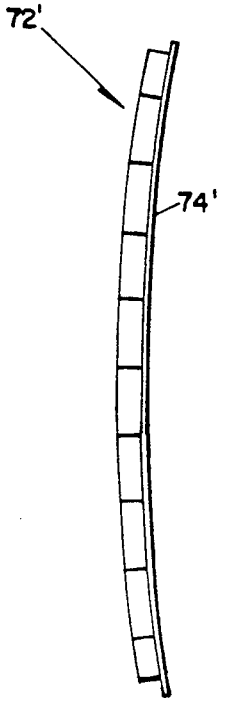
Figure 33:
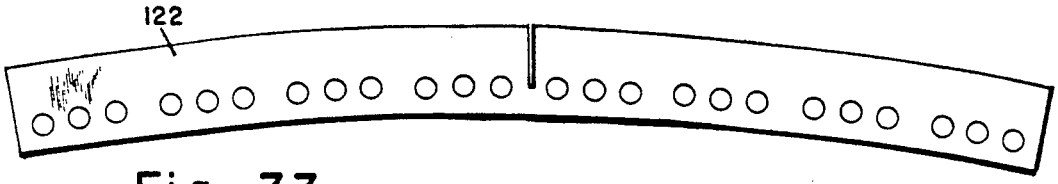
FIGS. 33–42 are side views illustrating the shapes of the ribs used in the back-up structure core assembly of FIGS. 31 and 32 in accordance with a second method of assembly; an FIG. 43 is a schematic illustration of a chemical vapor deposition furnace that may be used to effect SiC and Si deposits on a mirror faceplate and the back-up structure therefor as shown in FIGS. 12, 13, 31 and 32.
Figure 34:
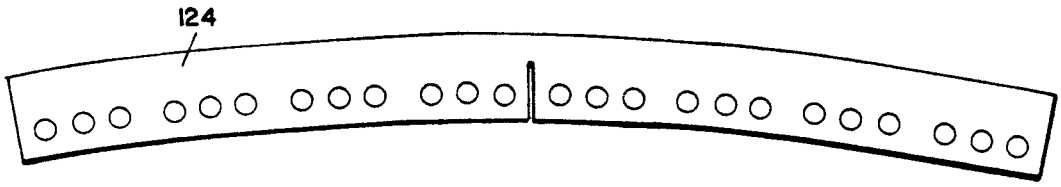
Figure 35:
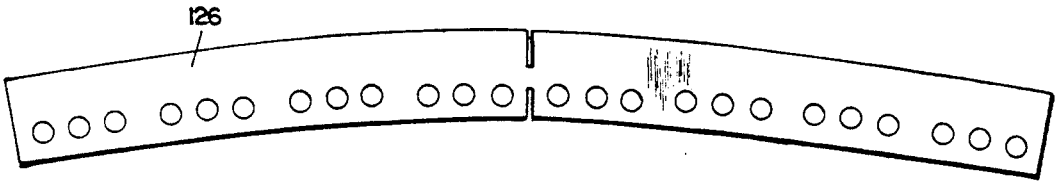
Figure 36:
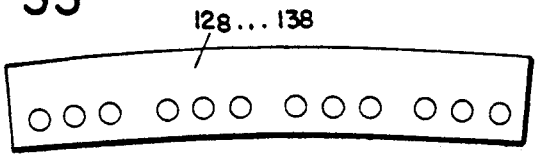

In accordance with the invention, the scaled up in size lightweight structure core may be assembled by a second method. According to this method, which is described with reference to FIGS. 31 and 32, in the assembly of a lightweight structure core 72', three central ribs 122, 124 and 126 are first attached at the centers thereof. One of these ribs, 122, has one slot in the center at the top, as shown in FIG. 33, another one, 124, has one slot in the center at the bottom, as shown in FIG. 34, and the third one, 126, has two slots, with one being in the center at the bottom and the other in the center at the top, as shown in FIG. 35. Then six ribs designated 128, 130, 132, 134, 136 and 138, all of which are of the same size, as illustrated in FIG. 36, are bonded to ribs 122, 124 and 126 to complete the large hexagon.

Figure 37:
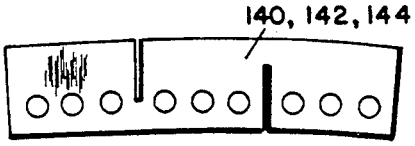
Figure 38:
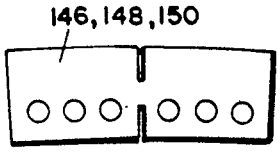
Figure 39:
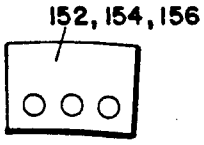
Figure 40:
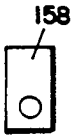
Figure 41:
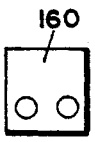
Figure 42:
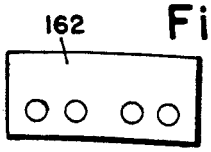

Each of the large triangles formed within the hexagon are then filled with smaller triangular cells. For example, ribs 140, 142 and 144, as illustrated in FIG. 37, are bonded. Each of ribs 140, 142 and 144 has a top slit and a bottom slit, which slots are spaced by a cell length. Then ribs 146, 148 and 150, which are of the same length, are locked in the center of the triangle and bonded at the edges. Such locking may be performed in the same manner as described hereinbefore. That is to say, one of the ribs 146 may have one slot at the bottom, another rib 148 may have one slot at the top, and the third rib 150 may have two slots, one at the top and one at the bottom, as shown in FIG. 38. Rib 150 and ribs 152 and 154, as shown in FIG. 39, are then locked and bonded at the edges. Finally, ribs 148 and 154, and a rib 156, also as shown in FIG. 39, are locked to complete the triangle. Once all six triangles, and hence, the large hexagon is all filled up, six outside closer modules are attached utilizing closure segments 158, 160, 162 as shown in FIGS. 40–42, respectively, and in FIG. 31. For convenience of illustration, the closure segments have not been shown in FIG. 32.

As shown in the following TABLE II, there are a total of 117 ribs or pieces required in the assembly of the lightweight structure core 72 utilizing the second method. The quantity of each piece required is given in the TABLE.

TABLE II

| Reference No. of Piece | Quantity | FIG. No. |
|---|---|---|
| 122 | 1 | 33 |
| 124 | 1 | 34 |
| 126 | 1 | 35 |
| 128 . . . 138 | 6 | 36 |
| 140 . . . 144 | 18 | 37 |
| 146 . . . 150 | 18 | 38 |
| 152 . . . 156 | 18 | 39 |
| 158 | 12 | 40 |
| 160 | 24 | 41 |
| 162 | 18 | 42 |

As contrasted with the ribs in the lightweight structure cores 10 shown in FIGS. 1–10 in which the bottom edges of the ribs are all located in the same plane, the bottom edges of the ribs of the lightweight structure cores 72 and 72', as best seen in FIGS. 13 and 33, respectively, curved, and hence, all portions thereof are not located in the same plane. The structure of FIGS. 1–10, as described, is appropriate for use in the fabrication of back-up structures for flat mirrors or other flat members; those of FIGS. 12–42 facilitate use in the fabrication of mirrors or other members having curved surfaces. This demonstrates the adaptability of the lightweight structure core of the invention for fabrication in various configurations.

Figure 43:
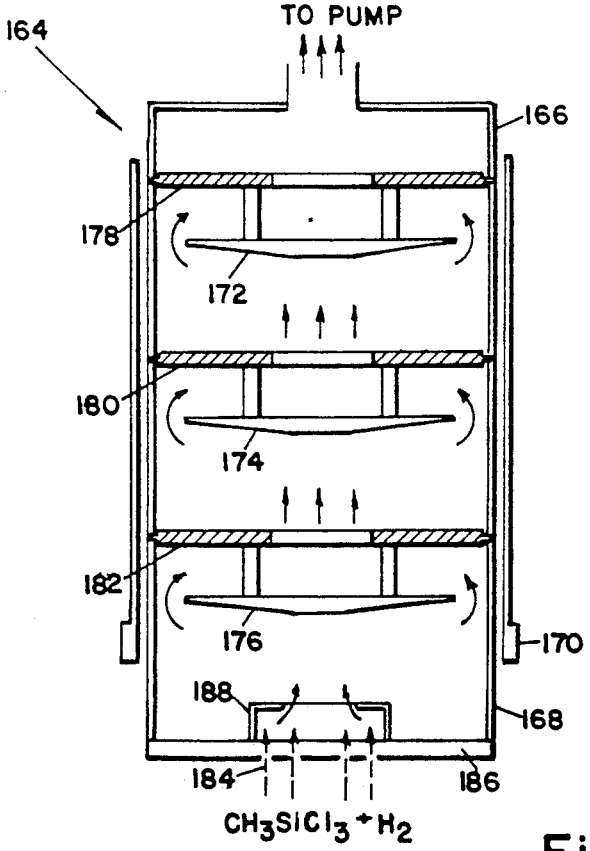

FIG. 43 illustrates a chemical vapor deposition system 164 that may be used to effect SiC and Si deposits on a mirror faceplate and the back-up structure therefor. The system 164 includes a furnace 166 comprising a vertically positioned graphite tube 168, electrical heating elements 170 that surround tube 168, three mandrels 172, 174 and 176, and three baffle plates 178, 180 and 182.

The mandrels 172, 174 and 176 are arranged in series and are fabricated from high density graphite having a thermal expansion coefficient larger than that of the chemical vapor deposited SiC. Each graphite mandrel 172, 174 and 176 is held with four graphite posts which, in turn, are attached to respectively associated graphite baffle plates 178, 180 and 182.

Each baffle plate is supported by the circular graphite tube 168 which encloses the deposition area and isolates the latter from the graphite heating elements 170.

Reagents, $CH_3SiCl_3$ and $H_2$, are introduced into the bottom of the tube 170 from four water-cooled injectors 184 mounted in the bottom cover 186 of tube 168.

In order to increase deposition efficiency and accommodate three mandrels in the chemical vapor deposition furnace, the first mandrel 172 is placed close to the injectors 184. To prevent the injectors 184 from producing "growth marks" on the first mandrel, a graphite manifold 188 was used which blunted the injector flow and allowed the reagents to flow uniformly through a large central hole. This arrangement provides a more uniform deposit on all three mandrels 172, 174 and 176.

$CH_3SiCl_3$ is a liquid at room temperature with a vapor pressure of about 140 torr at 20° C. It is carried to the deposition region by bubbling argon through two $CH_3SiCl_3$ tanks (not shown). The $CH_3SiCl_3$ flow from the two tanks is divided into four parts which pass through the four injectors. The pressure and temperature of the $CH_3SiCl_3$ tank and the argon flow rates are maintained the same for both tanks to obtain a uniform deposition.

EXAMPLE III

The chemical vapor deposition mirror fabrication technology was scaled from a small horizontal research furnace to a pilot-plant size production furnace capable of fabricating a 40-cm.-diameter mirror. A 40-cm.-diameter mirror was designed. The salient features of the arrangement are given in TABLE III.

TABLE III 40-cm.-DIAMETER Si/SiC MIRROR DESIGN FEATURES

| | Inch | cm. |
|---|---|---|
| Si Cladded SiC Faceplate | | |
| Si Cladding Thickness | 0.020 | 0.05 |
| SiC Faceplate Thickness | 0.088 | 0.22 |
| Faceplate Total Thickness | 0.108 | 0.27 |
| SiC Lightweight Structure | | |
| Wall Thickness | 0.064 | 0.163 |
| Cell Height | 1.28 | 3.25 |
| Cell Length | 1.97 | 5.00 |
| Flow Hole Diameter | 0.275 | 0.70 |
| Hole Center Distance From Edge | 0.40 | 1.02 |

TABLE III-continued

| 40-cm.-DIAMETER Si/SiC MIRROR DESIGN FEATURES | Inch | cm. |
|---|---|---|
| No. of Equilateral Triangular Cells | 96.0 | 96.0 |
| Cell Aspect Ratio | 1.3 | 1.3 |
| Si/SiC Mirror | | |
| Mandrel Diameter | 16.0 | 40.48 |
| Radius of Curvature | 39.37 | 100.0 |
| Total Mirror Thickness | 1.388 | 3.52 |
| Center Depth | 0.82 | 2.09 |

The mirror design assumed a polishing load of −1 psi, a peak-to-valley intercell sag of −0.025 μm, a peak-to-valley self-weight gravity distortion between supports (20 cm. apart) of −0.025 μm, and a minimum natural frequency of 25 Hz. The weight of the mirror is 2.94 kg which corresponds to a weight specification of about 19 kg per meter squared.

In order to scale the SiC back-up structure, first the graphite core is scaled. The lightweight structure consisted of 16 hexagonal cells containing a total of 96 triangular cells. The cell aspect ratio, defined as the cell depth to the diameter of the inscribed circle, is 1.3 for each triangular cell.

The scaling of the chemical vapor deposition fabrication technology to the required size involves the following:

(a) Material scaling. The optimum chemical vapor deposition process conditions which produced the Si and SiC materials in the research furnace were scaled to the pilot-plant size furnace. This scaling was performed keeping the following parameters unchanged: (1) deposition rate, (2) deposition setup geometically similar to the one used in the research furnace, (3) deposition temperature, and (4) furnace pressure. In addition, nondimensional chemical vapor deposition process parameters were identified and important scaling laws were develped. Based on these laws, reagent flow rates, molar ratio, and injector diameter were fixed. The scaling laws were validated by fabricating Si and SiC plates of size 32 cm.×90 cm. and 0.63 cm. in the pilot-plant size furnace. Important physical, optical, mechanical, and thermal properties of this material were compared with those corresponding to the research material, and were found to be identical.

(b) Scaling of the chemical vapor deposition mirror fabrication technology. This involves scaling of the replicated faceplate.

The scaled graphite core was placed on the backside of the SiC faceplate and coated with SiC in the pilot-plant size furnace. After this was accomplished, the SiC faceplate was separated from the graphite mandrel and the front of the faceplate was coated with chemical vapor deposited Si.

Thus, in accordance with the invention, there has been provided unique lightweight structures and improved methods that enable simplification in, reduction of time required for, and cost of their fabrication. The structures provided are comprised of vapor deposited material such as SiC or Si in a monolithic form. The structures, while light in weight, are characterized by being very stiff and strong and in having extreme figure stability retention. The structures are further characterized in having an extraordinary adaptability for fabrication in various predetermined configurations, for being scaled up in size, and in having utility in a variety of diverse applications including back-up structure for mirrors.

With this description of the invention in detail, those skilled in the art will appreciate that modifications may be made to the invention without departing from its spirit. Therefore, it is not intended that the scope of the invention be limited to the specific embodiment illustrated and described. Rather, it is intended that the scope of the invention be determined by the appended claims and their equivalents.

What is claimed is:

1. A method of fabricating a lightweight structure from a plurality of ribs each of which have substantially the same height and thickness with the height and length greatly exceeding the thickness, with each of said ribs having a center, a first elongated edge and a second elongated edge, comprising the steps of:

(a) forming from a first set of said ribs, each of which are of substantially the same length, a hexagonal cell having a plurality of pairs of most widely spaced corners and a depth equal to the height of said ribs, (b) forming slots in the center of first, second and third ones of a second set of said ribs which ribs are all of the same length and substantially equal to the distance between the most widely spaced corners of said hexagonal cell, with a first slot from the first elongated edge of a first one of said ribs, a second slot from the second elongated edge of said second one of said ribs, and third and fourth slots from the first elongated edge and the second elongated edge, respectively, of said third one of said ribs, with the lengths of said first and second slots being greater than half the height of said ribs and the lengths of said third and fourth slots being less than half the height of said ribs, (c) interlocking said first, second and third ones of said second set of ribs at the centers thereof by bringing said first and second slots into cooperative relation with said third and fourth slots, respectively, (d) positioning said interlocked first, second and third ones of said second set of ribs relatively to said hexagonal cell to connect the most widely spaced corners thereof thereby forming a structure core having six regions each of equilateral triangular cross section with each such region comprising a cell, and (e) exposing the structure core to a vapor deposition process thereby depositing and coating thereon a stiffening and strengthening material thereby enclosing said structure core in a monolithic structure of such material.

2. A method as defined by claim 1 including the further step (f) between steps (d) and (e) of providing a plurality of cells in each of said six cells of said structure core by positioning a plurality of ribs of a third set of said ribs in uniformly spaced and parallel relation on opposite sides of each of said first, second and third ribs of said second set of ribs, with all of the ribs of said third set of ribs associated with each side of said first, second and third ribs of said second set being of different length and including appropriately positioned slots along the first elongated edges thereof for cooperation with appropriately positioned slots in the second elongated edges in said first, second and third ribs of said second set of ribs at positions of intersection therewith such as to allow such intersection and interlocking therewith.

3. A method as defined by claim 2 wherein in step (f) said third set of ribs comprises four ribs positioned in uniformly spaced and parallel relation on each side of said first, second and third ribs of said second set of ribs, respectively, whereby sixteen equilateral triangular volumes comprising sixteen cells are produced in each of the six cells of equilateral triangular cross section.

4. A method as defined by claim 1 including the further step (h) between steps (d) and (e) of filling the six cells of equilateral triangular cross section with equally spaced ribs of a third set that are positioned in parallel relation to said ribs of said second set thereby forming smaller cells of equilateral triangular cross section bonded together to complete the structure core.

5. A method as defined by claim 4 including the further step (i) between steps (a) and (b) of placing said first, second and third ones of said ribs of said second set of said ribs on the surface of a circular substrate. and the further step (j) after step (h) of closing the structure core with ribs of a fourth set to cover a greater portion of the area of the circular substrate.

6. A method as defined by claim 3, further including the step (g), after step (f), of positioning a fourth set of ribs at an outer periphery of the structure core, thereby forming a closure for each of said six cells of equilateral triangular cross section, said fourth set of ribs including three ribs for each of said six cells connected to ends of the associated ribs of said third set of ribs, whereby the outer periphery of the structure core is transformed from a hexagon cross section having six sides to a polygon cross section having eighteen sides.

7. A method as defined by claim 6, wherein all of said ribs are made of graphite and the stiffening and strengthening material is SiC.

* * * * *